US005715853A

United States Patent [19]

Lin

[11] Patent Number: 5,715,853

[45] Date of Patent: Feb. 10, 1998

[54] STRUCTURE FOR COMBINING FRAMES OF AN UMBRELLA

[75] Inventor: Yao-chin Lin, Tainan, Taiwan

[73] Assignee: Asia Umbrella Industries Co., Ltd., Tainan, Taiwan

[21] Appl. No.: 779,132

[22] Filed: Jan. 6, 1997

[51] Int. Cl.[6] ..... A45B 25/00

[52] U.S. Cl. ..... 135/29; 135/32; 403/59

[58] Field of Search ..... 135/29, 30, 31, 135/32, 27, 37, 25.1, 25.3, 25.31, 25.32; 403/170, 174, 178, 217, 59, 53

[56] References Cited

U.S. PATENT DOCUMENTS

| | | | |
|---|---|---|---|
| 929,536 | 7/1909 | Babbit | 135/32 |
| 1,436,320 | 11/1922 | Ostman | 135/29 X |
| 2,221,289 | 11/1940 | Okum | 135/31 |
| 2,385,575 | 9/1945 | Isler | 135/29 |
| 2,474,516 | 6/1949 | Daniel | 135/29 |
| 2,761,461 | 9/1956 | Mappin et al. | 135/29 X |
| 3,021,854 | 2/1962 | Uthemann | 135/32 |
| 4,368,749 | 1/1983 | Lindler et al. | 135/30 X |
| 5,193,566 | 3/1993 | Chen | 135/29 X |
| 5,372,155 | 12/1994 | You | 135/29 |

*Primary Examiner*—Lanna Mai
*Attorney, Agent, or Firm*—Foley & Lardner

[57] ABSTRACT

A structure which is easy to be assemble and can firmly combine a rib with a stretcher of an umbrella is disclosed. The structure comprises a fastening and a link. The fastening has a body defining a passage for receiving a rib of the umbrella and a locating piece integrally extending from an outer periphery of the body. The locating piece defines a slot perpendicular to and in communication with the passage. The link has a block. The block defines a front end and a rear end, a first plate integrally extending outwardly from a bottom of the front end, a second plate integrally extending outwardly and upwardly from a top face thereof at the front end, and a pipe integrally extending from the rear end thereof for receiving a stretcher of the umbrella. The block further defines two concave side walls extending between the front end and the rear end thereof to conform with the outer periphery of the body. The first plate has a boss which extends from a surface thereof and is allowed to extend through the slot of the locating piece. The boss further has a head on a top thereof with a diameter slightly larger than the boss. The second plate defines a hole therein to snappingly receive the head of the boss.

2 Claims, 6 Drawing Sheets

STRUCTURE FOR COMBINING FRAMES OF AN UMBRELLA

FIELD OF THE INVENTION

The present invention relates to a structure for combining frames of an umbrella, and more particularly to a structure which is easy to assemble and can be firmly engaged with a rib and a stretcher of an umbrella.

DESCRIPTION OF RELATED ART

A conventional structure for combining ribs and stretchers of an umbrella typically has a configuration as shown in FIG. 5. A rib 60 and a stretcher 74 are both generally made of fiberglass reinforced plastics (FRP) having light weight and being shaped as a solid long lever with a round cross section. A fastening 50 is mounted onto the rib 60. A plurality of links 70 are respectively mounted on one end of the rib 60 and two ends of the stretcher 74. The two links 70 on the stretcher 74 are respectively engaged with the fastening 50 on the rib 60 and runner 81 on a shaft (not numbered) of the umbrella. The link 70 which is mounted on one end of the rib 60 is engaged with a circular flange 80 at a top of the shaft of the umbrella. By this arrangement, when the runner 81 is urged upwardly or downwardly on the shaft, the umbrella can be opened or closed.

Referring to FIG. 6 and FIG. 7, the fastening 50 has a body which defines a passage (not numbered) for receiving the rib 60. The body further defines two pairs of aligned holes 51 perpendicular to and communicating with the passage. A cementing agent is applied into the passage so as to securely retain the rib 60 in the body after the rib 60 has been inserted therein. The body further has a pair of opposed wings 52 extending from an appropriate portion of an outer periphery thereof. The two wings 52 define a pair of opposed holes 53 therein. The link 70 is configured to have a flat front portion 72 and a pipe-like rear portion (not numbered). The pipe-like rear portion receives a tip of the stretcher 74 and defines a cross-bore 71 therein by which the stretcher 74 can be combined with the pipe-like rear portion in a manner similar to that of the rib 60. The flat front portion 72 of the link 70 is received in a space defined by the two wings 52 of the fastening 50 and defines an aperture 73 therein aligning with the opposed holes 53 of the wings 52, such that a pin 54 is able to extend through the holes 53 and the aperture 73 to engage the fastening 50 with the link 70. In this way, the stretcher 74 can pivot about the pin 54 with respect to the rib 60 for opening or closing the umbrella.

This kind of structure for combining ribs and stretchers of an umbrella has several disadvantages. One is that the holes 53, the aperture 73 and the pin 54 are so small that the engagement therebetween is inconvenient. A second disadvantage is that the pin 54 made of metal easily rusts and easily breaks due to a shear force resulted from the stretcher 74 pivoting around the pin 54.

The present invention provides an improved structure for combining frames of an umbrella to mitigate and/or obviate the aforementioned problems.

SUMMARY OF THE INVENTION

One object of the present invention is to provide a structure for easy assembly of ribs and stretchers of an umbrella and by which a rib can firmly engage with a stretcher of an umbrella.

In accordance with one aspect of the present invention, a structure for combining a rib and a stretcher of all umbrella comprises a fastening and a link. The fastening has a body defining a passage for receiving a rib of the umbrella and a locating piece integrally extending from an outer periphery of the body. The locating piece defines a slot perpendicular to and in communication with the passage. The link has a block. The block defines a front end and a rear end, a first plate integrally extending outwardly from a bottom of the front end, a second plate integrally extending outwardly and upwardly from a top face thereof at the front end, and a pipe integrally extending from the rear end thereof for receiving a stretcher of the umbrella. The first plate has a boss which extends from a surface thereof and is allowed to extend through the slot of the Locating piece. The boss further has a head on a top thereof with a diameter slightly larger than the boss. The second plate defines a hole therein to snappingly receive the head of the boss.

In accordance with the present invention, the block further defines two concave side walls extending between the front end and the rear end thereof to conform with the outer periphery of the body.

Other objects, advantages and novel features of the invention will become more apparent from the following detailed description when taken in conjunction with the accompanying drawings.

DETAILED DESCRIPTION OF PREFERRED EMBODIMENT

Figure 1:
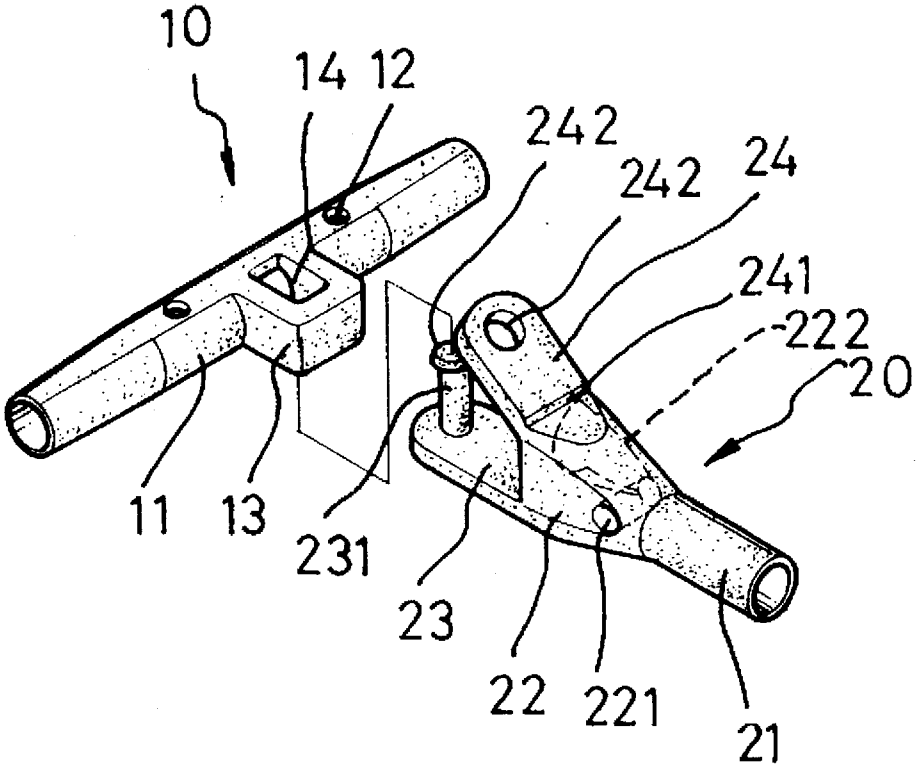
FIG. 1 is a perspective view showing a structure for combining a rib and a stretcher of an umbrella in accordance with the present invention.
Figure 2:
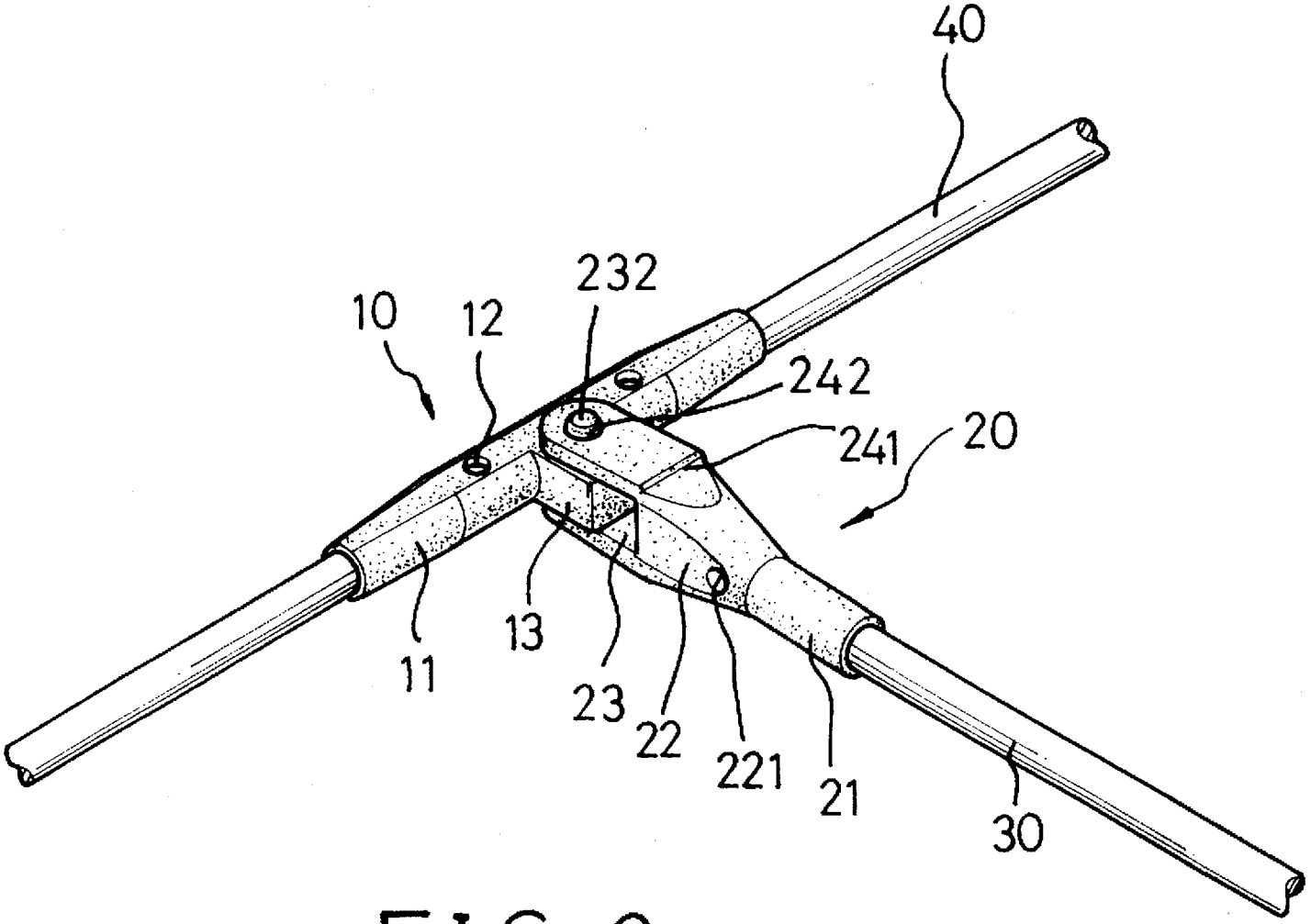
FIG. 2 is a perspective view showing the structure used with the ribs and stretchers of the umbrella in accordance with the present invention.

Referring to FIG. 1 and FIG. 2, a structure for combining a rib and a stretcher of an umbrella in accordance with the present invention comprises a fastening 10 and a link 20. The fastening 10 is configured to have a body 11 defining a passage (not numbered) for receiving a rib 40 of the umbrella. A locating piece 13 integrally extends from an outer periphery of the body 11 and defines a slot 14 perpendicular to and in communication with the passage.

The link 20 has a block 22. The block 22 has a front end, a rear end, a substantially horizontal bottom face, and a slightly inclined top face. Two side walls 222 extending between the front end and the rear end are respectively shaped concave to conform with the outer periphery of the body 11 of the fastening 10. A pipe 21 integrally extends from the rear end of the link 20 for receiving a stretcher 30 of the umbrella. A first plate 23 extends integrally and outwardly from a bottom of the front end of the block 22.

The first plate 23 has a boss 231 integrally extending from a top face thereof. It is to be noted that a height of the boss 231 is substantially the same as a height of the locating piece 13 so that the boss 231 can extend through the slot 14 of the locating piece 13. The boss 231 has a head 232 formed on a top thereof. A diameter of the head 232 is slightly larger than that of the boss 231 and smaller than a width of the slot 14. A second plate 24 extends integrally and outwardly from the top face of the block 22 at the front end. The second plate 24 is inclined away from the first plate 23 more sharply than the top face of the block 22, so that a crease 241 is defined between the second plate 24 and the top face of the block 22 and allows the second plate 24 to be resiliently and downwardly pressed. Furthermore, the second plate 24 defines a hole 242 therein slightly smaller in diameter than the head 232 of the boss 231 of the first plate 23 in order to snappingly receive the head 232 of the boss 231 when it is pressed downwardly.

Figure 3:
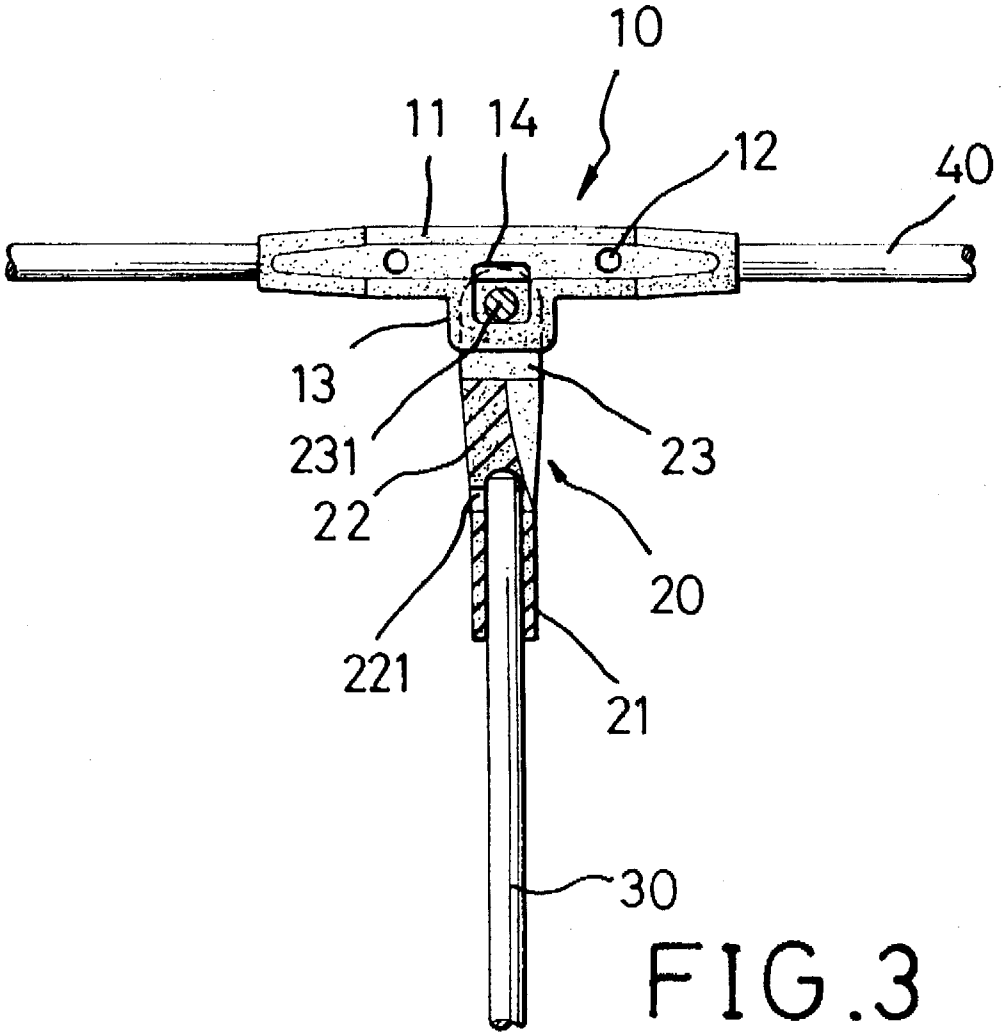
FIG. 3 is a partial cross-sectional view of the invention showing the structure combining the ribs and stretchers of the umbrella in accordance with the present invention.

Referring to FIG. 2 and FIG. 3, before the rib 40 engages with the stretcher 30, a cementing agent may be implanted from the slot 14 into the passage of the body 11 of the fastening 10, then the rib 40 is inserted into the passage of the body 11 and thus is attached thereto by means of the cementing agent. Also, a cementing agent may be applied into the pipe 21 of the link 20. Then stretcher 30 may be disposed in the pipe 21 and retained thereto in a manner similar to that of the rib 40, and the boss 231 of the first plate 23 is extended through the slot 14 of the locating piece 13. By pressing the second plate 24 downwardly, the hole 242 of the second plate 24 will snappingly receive the head 232 of the boss 231 and be retained at an undersurface of the; head 232, thereby the link 20 mounted with the stretcher 30 can be pivotably engaged with the fastening 10 mounted with the rib 40. It is also to be noted that when the stretcher 30 is pivoted with respect to the rib 40, the concave side walls 222 of the block 22 will closely mate with the outer periphery of the fastening 10 so that a satisfactory folding effect can be obtained.

Figure 4:
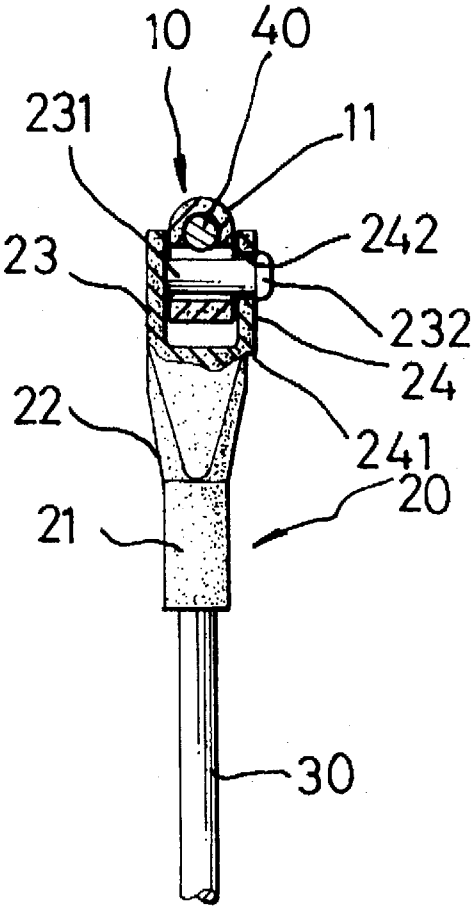
FIG. 4 is another partial cross-sectional view of the invention showing the structure combining the rib and stretcher of the umbrella in accordance with the present invention.
Figure 5:
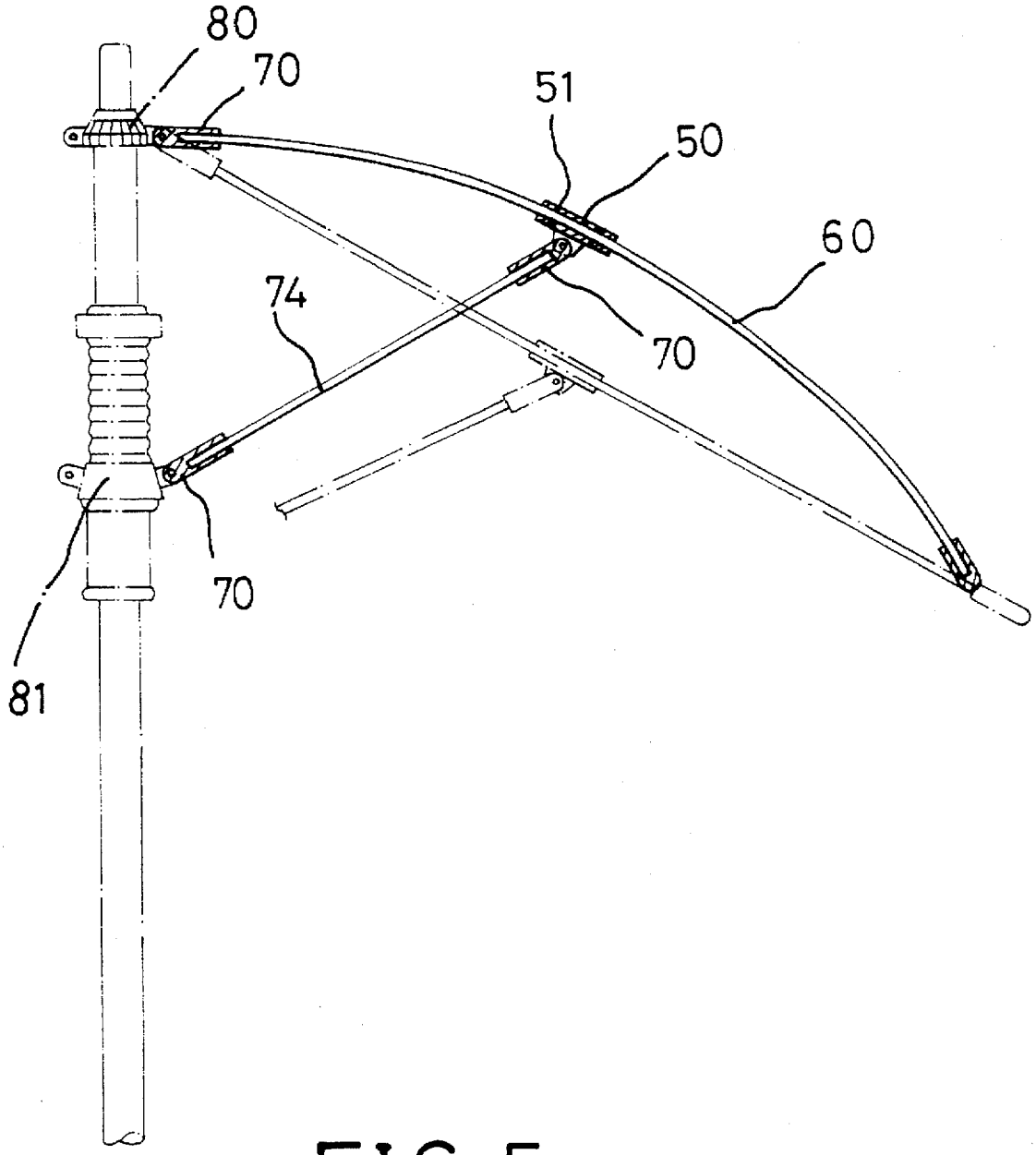
FIG. 5 is a schematic view showing a conventional combining structure for frames of an umbrella.
Figure 6:
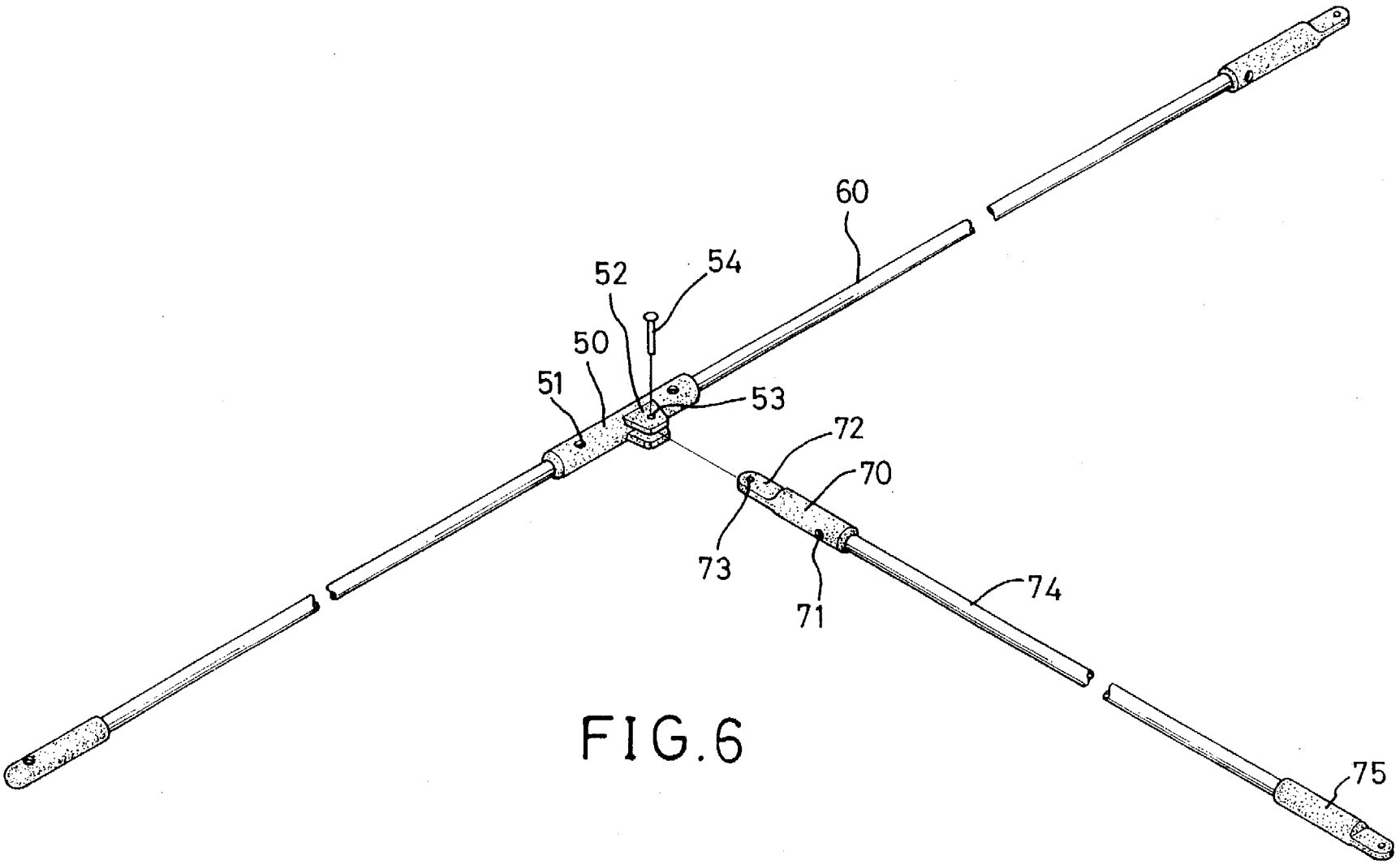
FIG. 6 is a perspective view showing the conventional combining structure in FIG. 5.
Figure 7:
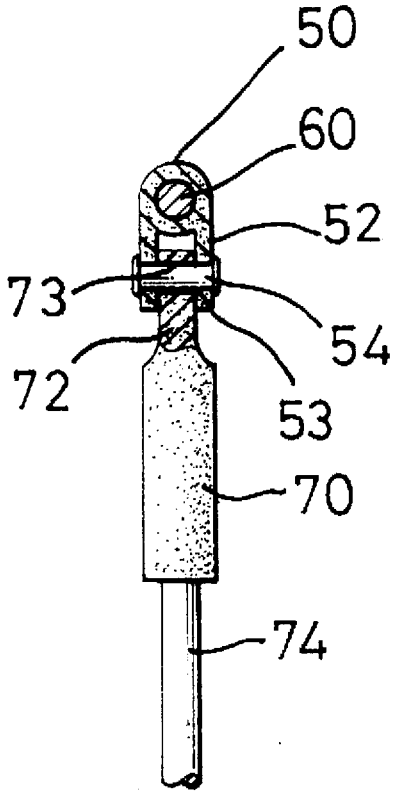
FIG. 7 is a cross-sectional view showing the conventional combining structure in FIG. 5.

Referring to FIG. 4, since the connections between the boss 231 and the slot 14, the first plate 23 and the undersurface of the locating piece 13, the second plate 24 and the surface of the locating piece 13 are of large contact areas, a shear force to the boss 231 resulted from the stretcher 30 pivoting about the boss 231 can be minimized. Accordingly, the present invention is not only easily to be assembled, but also obtains a firm engagement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A structure for combining frames of an umbrella comprising:

a fastening having:

a body defining a passage for receiving a rib of the umbrella, and a locating piece integrally extending from an outer periphery of the body and defining therein a slot perpendicular to and in communication with the passage; and a link having:

a block defining a front end and a rear end, a first plate integrally extending outwardly from a bottom of the front end, a second plate integrally extending outwardly and upwardly from a top face thereof at the front end, and a pipe integrally extending from the rear end thereof for receiving a stretcher of the umbrella, wherein, said first plate has a boss extending from a surface thereof and through the slot of the locating piece, said boss has a head on a top thereof, the diameter of the head being slightly larger than the diameter of the boss, and said second plate defines a hole therein to detachably and snappingly receive the head of the boss.

2. A structure for combining frames of an umbrella as claimed in claim 1, wherein said block further defines two concave side walls extending between the front end and the rear end thereof to conform with the outer periphery of the body.

* * * * *